United States Patent [19]

Dittrich

[11] 4,413,446

[45] Nov. 8, 1983

[54] THRESHOLD ASSEMBLY

[75] Inventor: Sebastian Dittrich, Clifton, N.J.

[73] Assignee: Magnetic Weather Stripping Corp., Clifton, N.J.

[21] Appl. No.: 294,105

[22] Filed: Aug. 19, 1981

[51] Int. Cl.[3] ..... E06B 1/70

[52] U.S. Cl. ..... 49/470; 49/478

[58] Field of Search ..... 49/469, 470, 471, 467

[56] References Cited

U.S. PATENT DOCUMENTS

| | | | |
|---|---|---|---|
| 2,611,158 | 9/1952 | Gregory | 49/305 |
| 3,604,152 | 9/1971 | Protzman | 49/478 X |
| 4,300,314 | 11/1981 | Dittrich | 49/470 |

FOREIGN PATENT DOCUMENTS

| | | | |
|---|---|---|---|
| 237741 | 10/1960 | Australia | 49/478 |

*Primary Examiner*—Kenneth Downey

*Attorney, Agent, or Firm*—Siegmar Silber

[57] ABSTRACT

An improved threshold assembly for mounting on a door and a door sill is described which includes a sill-mounted portion with a threshold plate formed of non-magnetically attracted material and a door-mounted portion with a door cap for mounting on the bottom edge of the door with a flexible magnet-holding device. Two elongated magnets are mounted one in each portion of the threshold assembly, and, when the door is in the closed position, the magnets are positioned one on top of the other. The magnets are structured so that the opposite edges have opposite polarity and are mounted with adjacent magnet edges having unlike polarity. During closing of the door, the edges of like polarity approach and repel one another and causes the magnet-holding device to move away from the threshold plate.

17 Claims, 5 Drawing Figures

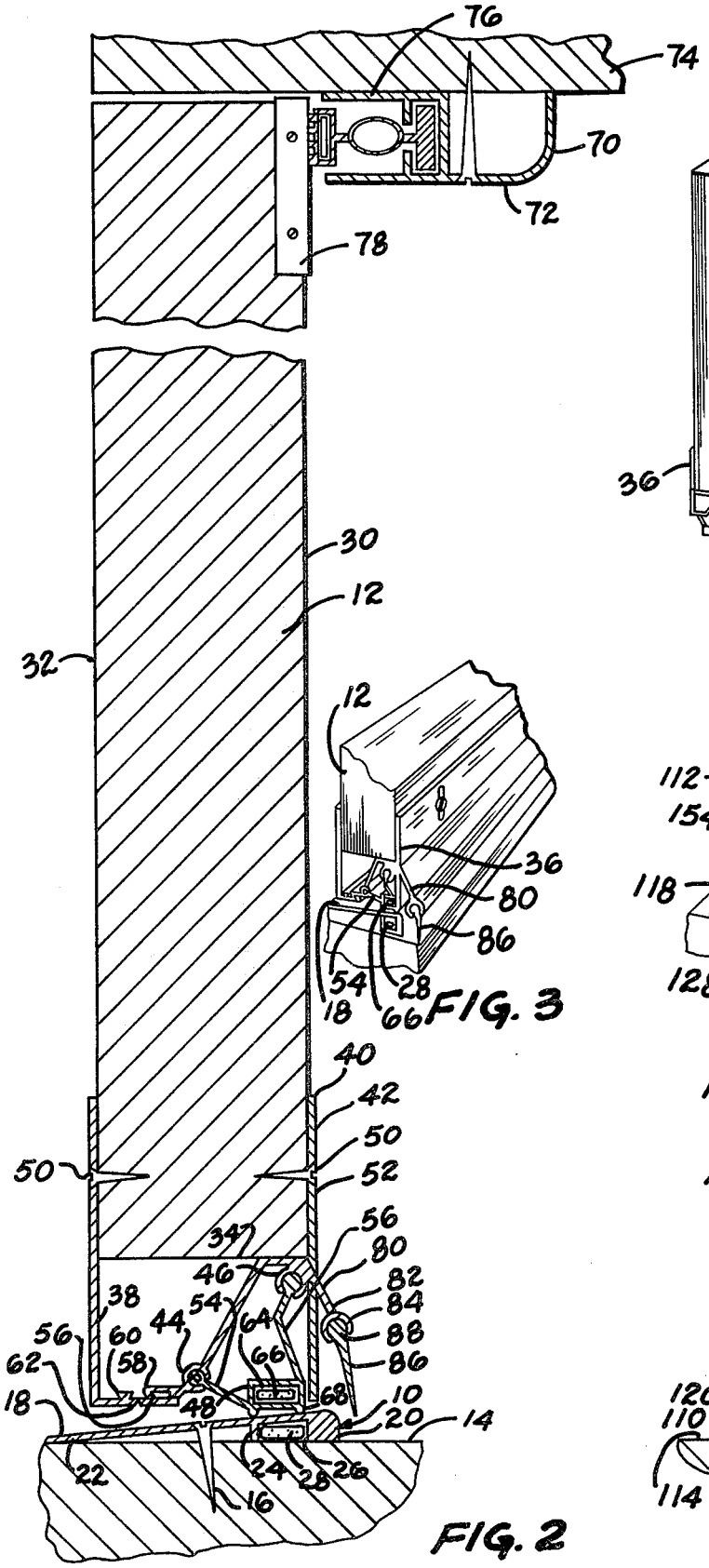
FIG. 2
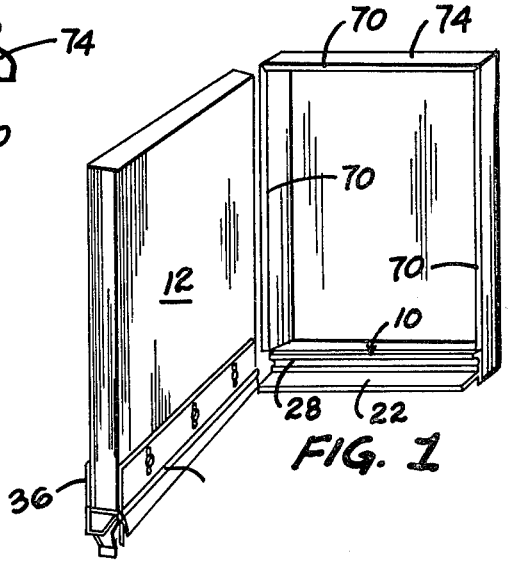
FIG. 1
FIG. 3
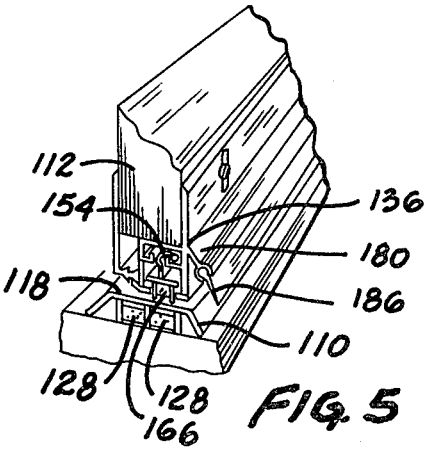
FIG. 5
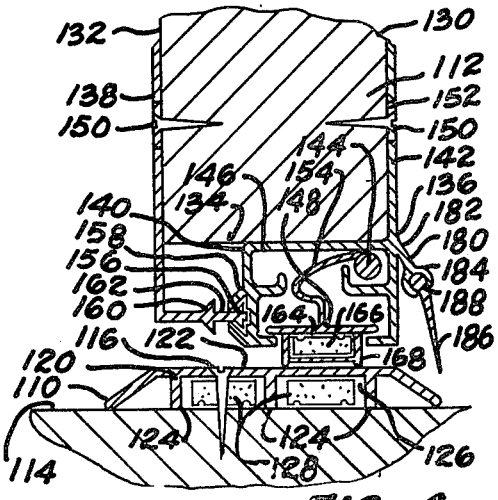
FIG. 4

THRESHOLD ASSEMBLY

BACKGROUND OF THE INVENTION

1. Field of the Invention

The present invention relates generally to an improved door sealing arrangement, and more particularly to an improved dual magnet sealing device for thresholds to protect against heating and cooling energy losses and to reduce dust infiltration.

2. Description of the Prior Art

In the past, doors with magnetic stripping sealing have been developed and used especially for cabinets and refrigerators. In these applications, the doors open outwardly from the protected area so that the sealing arrangement is larger than the opening and in general is constructed to be continuous about the periphery of the door. More recently, because of energy considerations, magnetic sealing weatherstripping closures have seen increasing use in homes and particularly for exterior openings. As a result, various constructions of magnetic weather stripping and magnetic sealing doors have been proposed. By way of example, in the patent to Gregory, U.S. Pat. No. 2,611,158, a weatherstrip construction is taught wherein the metal weatherstrip is flexibly mounted on a fixed element which is provided with a hook. In the sealing mode of operation, the weatherstrip is rotated about the hook until arcuate path of travel is further prevented by the rubber strip.

The threshold invented by Protzman, U.S. Pat. No. 3,604,152 shows a device with a ferrous strip incorporated therein to seal by magnetic attraction against a member carrying a magnet. It is interesting to note that the L-shaped channel causes the assembly to be somewhat skewed from vertical.

A review of the art shows that these threshold constructions would tend, within a relatively short period of time, to wear or to work fatigue the vinyl extrusion that carries the magnet element. Further, limited attention is given to facilitation of removing and replacing of magnets and magnetic elements. The magnetic weatherstripped threshold construction of the invention is designed so that all parts of a magnetic sealing system are easily removed, cleaned and installed or replaced. Thus the invention is more adapted to the actual conditions in which a threshold works, namely dust, dirt, and repetitive exposure to door action and foot traffic.

SUMMARY OF THE INVENTION

According to the invention herein, there is described a threshold assembly for mounting on a door and a door sill which includes a sill-mounted portion and a door-mounted portion. The sill-mounted portion includes a threshold plate formed of nonmagnetically attracted material and a door-mounted portion with a door cap for mounting on the bottom edge of the door with a flexible magnet-holding device. Two elongated magnets are mounted one in each portion of the threshold assembly, and, when the door is in the closed position, the magnets are positioned one on top of the other. The magnets are structured so that the opposite edges have opposite polarity and are mounted with adjacent magnet edges having unlike polarity. During closing of the door, the edges of like polarity approach and repel one another and causes the magnet-holding device to move away from the threshold plate.

While various structures could accomplish this end, in the "best mode" of this invention described in the preferred embodiment, the door mounted portion is formed from two extrusions—a door cap having two sockets and a magnet-holding device having arms that mount in the sockets. Then upon magnetic repulsion, the arm retracts lifing the magnet and magnet holding device away from the threshold plate. This minimizes wear on the device.

OBJECTS OF THE INVENTION

It is an object of this invention to provide an improved sealing arrangement for an access door, which is constructed and provided with magnetic edge seals.

It is also an object to provide special construction of a threshold which will allow one to remove and replace all parts of the magnetic sealing arrangement without removing the threshold plate.

A further object of the invention is the provisions of a readily and easily installed threshold-doorsill assembly with a magnetic seal incorporated therein.

A further object of the invention is the effective sealing of an exterior door by use of magnetic weatherstripping in combination with the magnetic seal of the threshold assembly.

A yet further object of the invention is the invention is the resistance to work fatigue in the moving portions of the weatherstripping structure.

Other objects and features of the invention will be apparent from reading the specificiation hereof.

The invention comprises the features of construction, combinations of elements, and arrangements of parts which is exemplified in the improved threshold assembly set forth; however, the technique described is applicable to other weatherstripping constructions. The scope of the invention will be indicated in the claims.

BRIEF DESCRIPTION OF THE DRAWINGS

With the above and additional objects and advantages in view as will hereinafter appear, this invention comprises the assembly, combinations and arrangements of parts hereinafter described and illustrated in the accompanying drawings of a preferred embodiment in which:

FIG. 1 is a perspective view of a door housing a magnetic-sealing device for threshold;

FIG. 2 is a cross-sectional elevation showing the components of a threshold assembly;

FIG. 3 is a partial perspective view of a magnet-holding assembly;

FIG. 4 is a cross-sectional elevation showing the components of a second embodiment of the magnetic-sealing device for a threshold; and FIG. 5 is a partial perspective view of the second embodiment of FIG. 4 with a portion thereof broken away.

DESCRIPTION OF THE PREFERRED EMBODIMENTS

For the purpose of this description the preferred embodiments are described in relationship to an inwardly opening exterior door. It is recognized that a practitioner can, within the state-of-the-art, apply the disclosed invention to a passage door on the interior of a building. For reference purposes, the outward portion of the door is referred to as an "exterior surface" and the inward portion (adjacent the hinge pins) is referred to as an "interior surface".

Referring now to the drawings, the invention is shown generally in FIG. 1 and in more detail in FIG. 2. The lower fragmentary portion of FIG. 2 illustrates the portion of the threshold assembly or the threshold plate installed on the door sill and is referred to generally as 10.

The bottom edge of the door 12 is positioned above a door sill 14. A door sill 14 has affixed thereto by means of screws 16 or the like a stationary threshold plate 18 formed of nonmagnetically attracted material. This plate has an end portion with a riser portion 20 which is substantially vertical and which extends along the bottom edge of the door 12 adjacent the exterior surface thereof. A saddle portion 22 which is substantially horizontal and which extends from the upper edge of the riser portion 20 to the sill portion 14. This plate has a medial support portion 24 which is constructed substantially vertically and extends from the underside of the threshold 18 to the sill 14. The medial support portion 24 and riser portion 20 forms an internal channel 26 therebetween for receiving a two-pole elongated magnetic strip 28. The saddle portion 22 and door sill 14 are structured to have a small angle a. therebetween, which angle allows for easy opening of the door. The small angle results in a threshold with a low silhouette thereby reducing tripping of people gaining access to and from the wall opening. The door 12 in the closed position is positioned above the threshold assembly 10, with an exterior surface 30, an interior surface 32 and the bottom edge 34.

A door cap assembly 36 for mounting on the bottom edge of the door includes a stepped portion on the bottom edge of the door. This portion has a lowermost portion 38 for mounting on interior surface 32 corresponding to saddle portion 22 and a uppermost portion 40 for mounting on exterior surface 30 corresponding to the riser portion 20. An exterior facing plate 42 of uppermost portion 40 extends along the bottom edge of the exterior surface 30 of the door. The door cap device extends horizontally and is formed integrally with sockets 44 and 46 for a magnet-holding device 48, the stepped portion and the exterior facing plate 42. The cap device is affixed to the door by means of screws 50 that are inserted in elongated slots 52. A magnet-holding device 48 has a ball and arm portion 54 which is attached to the lowermost socket 44 of the door's stepped portion. The magnet-holding device is further constructed to include a hinged arm and ball portion 56 (shown in the open position) which extends substantially vertically adjacent the facing plate 42. The ball of arm and ball portion 56 is housed in uppermost socket 46, and when the arm is retracted, arm 54 is in a substantially horizontal position and the magnet-holding device 48 rests behind the lower part of the exterior facing plate 42.

The two parts of the door cap assembly 36, namely lowermost portion 38 and uppermost portion 40, are connected by a tenon 56 and a mortise 58. An additional tenon 60 is provided for a thinner door 12. A scored line 62 is provided for selection of the appropriate joining device. In the U.S. market it is common for exterior doors to be supplied in two popular thicknesses and simple alternative structures are described hereinabove. However, it is within the scope of a man skilled in the state of the art to accommodate other sizes.

A magnetic-holding device 48, mounted in sockets 44 and 46 so as to be freely movable vertically adjacent facing plate 42, has a pocket 64 for receiving another two-pole elongated magnetic strip 66. The exterior face of pocket 64 (see FIG. 3) has rib members 68 extending longitudinally for facilitating disengagement of magnetic sealing during opening of the door.

The sealing construction generally referred to as 70, in the upper portion of the door 12, FIG. 2, differs in several respects from that previously described. A plate 72 is firmly attached to the door frame 74. A weather strip mounting means 76 secures the magnetic sealing means to bridge any gap door 12 and the frame 74. The door is provided about its side and top edges with an insert 78, of steel to form an attracting surface for the magnet of assembly 70.

In the preferred embodiment shown, an optical rain shield generally referred to as 80, is shown. The shield 80 has a deflector 82 attached at the upper end thereof to exterior facing plate 42 with a socket portion 84 at the lowermost end thereof. A wiper 86 has a ball device 88 for attaching the wiper to the socket portion 84 of deflector 82.

In the second embodiment another improved threshold structure is described with similar parts being given similar nomenclature. In this description parts in FIGS. 4 and 5 similar to corresponding parts in FIGS. 2 and 3 will be given reference designators in the "100" series. For example, the two-pole elongated magnetic strip 28, FIG. 2, corresponds to a two-pole elongated magnetic strip 128, FIG. 4.

Referring now to the drawings, the second embodiment of the invention is shown in FIGS. 4 and 5. The lower fragmentary portion of FIG. 4 illustrates the portion of the threshold assembly or the threshold plate installed on the door sill and is referred to generally as 110.

The bottom edge of the door 112 is positioned above a door sill 114. A door sill 114 has affixed thereto by means of screws 116 or the like a stationary threshold plate 118 formed of nonmagentically attracted material. This plate has an end portion with a riser portion 120 which extends along the bottom edge of the door 112 adjacent the exterior surface thereof. A saddle portion 122 which is substantially horizontal and which extends from the upper edge of the riser portion 120 to the sill portion 114. This plate optionally has one or more medial support portions 124 which are constructed substantially vertically and extend from the underside of the threshold 118 to the sill 114. The medial support portions 124 and riser portion 120 form one or more internal channels 126 therebetween for receiving a pair of two-pole elongated magnetic strips 128. The saddle portion 122 and door sill 114 are structured to have a small angle a. therebetween, which angle allows for easy opening of the door. The small angle results in a threshold with a low silhouette thereby reducing tripping of people gaining access to and from the wall opening. The door 112 in the closed position is positioned above the threshold assembly 110, with an exterior surface 130, an interior surface 132 and the bottom edge 134.

A door cap assembly 136 for mounting on the bottom edge of the door includes a channel portion on the bottom edge of the door. This portion has an interior support portion 138 for mounting on interior surface 132 corresponding to saddle portion 122 and a boxbeam portion 140 extends along the bottom edge of the exterior surface 130 of the door. The door cap device extends horizontally and is formed with one or two sockets, such as sockets 144 and 146 on the upper interior corners magnet-holding device 148. The channel portion, the sockets 144, and the exterior facing plate 142 are integrally formed. The cap device is affixed to the door by means of screws 150 that are inserted in elongated slots 152. A magnet-holding device 148 has a ball and arm portion 154 which is attached to the socket 144 of the boxbeam portion 140. The magnet-holding device is so constructed that when combined with the arm and ball portion 154 and boxbeam portion 140 and extended because of magnetic forces to the saddle portion 122, an air seal is achieved. With the door in the open position, the magnet-holding device is constructed to rest the lower part of boxbeam portion 140.

The two parts of the door cap assembly 136, namely interior support portion 138 and boxbeam portion 140, are connected by a tenon 156 and a mortise 158. An additional tenon 160 is provided for a thinner door 12. A scored line 162 is provided for selection of the appropriate joining device. In the U.S. market it is common for exterior doors to be supplied in two popular thicknesses and simple alternative structures are described hereinabove. However, it is within the scope of a man skilled in the art to accommodate other sizes.

A magnet-holding device 148, is mounted in socket 144 so as to be freely movable vertically and adjacent facing plate 142, has a pocket 164 for receiving another two-pole elongated magnetic strip 166. The exterior face of pocket 164 has rib members 168 extending longitudinally for facilitating disengagement of magnetic sealing during opening of the door.

As in the first preferred embodiment shown hereinabove, an optional rain shield generally referred to as 180, is also shown. The shield 180 has a deflector attached at the upper end thereof to exterior facing plate 142 with a socket portion 184 at the lowermost end thereof. A wiper 186 has a ball device 188 for attaching the wiper to the socket portion 184 of the deflector 182.

In operation, starting with an open door, the opposite pole regions are located at each lengthwise edge of the magnets. The magnets 28 or 128 and 66 or 166 as the first interaction of the respective fields occur tend to repel each other and thereby lift up the magnet-holding extrusion 48 or 148. However, as the door closes the opposite poles are alined and attracted one to the other, thereby providing the desired magnetic sealing effect. The repulsion and then attraction sequence eliminates any dragging of the vinyl extrusion across the threshold plate and protects the life of the weatherstripping unit.

Although the present invention has been described with reference to particular embodiments and examples it will be apparent to those skilled in the art that variations and modifications can be substituted therefor without departing from principles and true spirit of the invention. The "Abstract" given above is for the convenience of technical searchers and is not to be used for interpreting the scope of the invention of claims.

What is claimed is:

1. An improved threshold assembly for mounting on a door and a door sill comprising:

a. a sill mounted portion comprising, in turn:

(1) a threshold plate formed of non-magnetically attracted material, said plate having a substantially vertical end portion at one side thereof;

(2) a support depending from said threshold plate, said support and said end portion forming at least one internal channel therebetween;

(3) at least one first elongated magnet means for insertion in said channel having an area of first polarity on the edge adjacent said end portion and an area of second polarity on the opposite edge thereof;

(4) attachment means for attaching said threshold plate to said door sill;

b. a door-mounted portion comprising, in turn:

(1) a door cap attached to the lower edge of said door and extending downwardly therefrom toward said threshold plate;

(2) magnet-holding means for supporting with the door in the closed position second elongated magnet means adjacent and above said first elongated magnet means, said magnet-holding means flexibly attached to said door cap;

(3) second elongated magnet means mounted in said magnet-holding means having an area of second polarity on the edge adjacent said end portion and an area of first polarity on the opposite edge thereof;

(4) attachment means for attaching said door cap to the lower edge of said door;

whereby, upon closing said door, at the nearly closed position the areas of like polarity of said first and said second magnet means repel and move said magnet-holding means away from said threshold plate and then at the closed position, the areas of unlike polarity of said first and said second magnet means attract to seal the door-mounted portion to the sill-mounted portion.

2. An improved threshold assembly as described in claim 1 wherein said door-cap further comprises:

a. first facing plate attached to the bottom of one side of said door so that with the door in the closed position, said first facing plate is adjacent said end portion;

b. second facing plate attached to the bottom of the side opposite of said door; and c. a support plate attached to an joining the interior surfaces of said first and said second facing plates and forming a longitudinal slot adjacent the bottom of said first facing plate.

3. An improved threshold assembly as described in claim 2 wherein said support plate is in turn comprised of a first support plate portion attached to said first facing plate; a second support plate portion attached to said second facing plate; and adjustable interconnection means for attaching said first and said second support plate portion as predetermined by the thickness of said door.

4. An improved threshold assembly as described in claim 3 wherein said adjustable interconnection means comprises at least one mortise in one of said support plates and at least one tenon in the order of said support plates, said mortise and said tenon positioned to be adjustably inserted the one into the other.

5. An improved threshold assembly as described in claim 3 wherein at least two socket means for retaining said magnet-holding means are formed in the lower surface of said support plate; one of said socket means adjacent the juncture of said first facing plate and said first support plate portion; and another one of said socket means adjacent the juncture of said first and said second support plate portions.

6. An improved threshold assembly as described in claim 5 wherein said magnet-holding means includes at least two flexible arm members terminating in ball-like portion for interconnection with said socket means.

7. An improved threshold assembly as described in claim 6 wherein said magnet-holding means, with said second elongated magnet therein and without any magnetic forces acting thereupon rests with said magnet adjacent the lower edge of said first facing plate.

8. An improved threshold assembly as described in claim 6 wherein said magnet-holding means is a vinyl extrusion by which is integrally formed a pocket for retaining said second elongated magnet means, said flexible arm members, and said ball-like portions at the outer edge thereof.

9. An improved threshold assembly as described in claim 8 wherein said pocket has rib members in the outer face thereof and extending longitudinally thereon for facilitating disengagement of magnetic sealing during opening of the door.

10. An improved threshold assembly as described in claim 2 wherein said first facing plate further comprises an externally mounted deflector means for shedding precipitation beyond the threshold area.

11. An improved threshold assembly as described in claim 2 wherein said support plate is in turn comprised of a boxbeam portion attached to said first facing plate; a support plate portion attached to said second facing plate; and adjustable interconnection means for attaching said boxbeam and said support plate portions as predetermined by the thickness of said door; and said first elongated magnet means is in turn comprised of two said first elongated magnet means for insertion in said channel with adjacent edges thereof having areas of like polarity.

12. An improved threshold assembly as described in claim 11 wherein said adjustable interconnection means comprises at least one mortise in one of said support plates and at least one tenon in the other of said support plates, said mortise and said tenon positioned to be adjustably inserted the one into the other.

13. An improved threshold assembly as described in claim 11 wherein as least one socket means for retaining said magnet-holding means are formed in the upper interior corners of said Boxbeam position.

14. An improved threshold assembly as described in claim 13 wherein said magnet-holding means includes at least one flexible arm member terminating in ball-like portion for interconnection with said socket means.

15. An improved threshold assembly as described in claim 14 wherein said magnet-holding means, with said second elongated magnet therein and without any magnetic forces acting thereupon rests with said magnet adjacent the lower edge of said first facing plate.

16. An improved threshold assembly as described in claim 14 wherein said magnet-holding means is a vinyl extrusion with a pocket for retaining said second elongated magnet means, said extrusion integrally formed with said flexible arm member and said ball-like protion thereof.

17. An improved threshold assembly as described in claim 16 wherein said pocket has rib members in the outer face thereof and extending longitudinally thereon for facilitating disengagement of magnetic sealing during opening of the door.

* * * * *